US009249377B2

(12) United States Patent
Shriner

(10) Patent No.: US 9,249,377 B2
(45) Date of Patent: Feb. 2, 2016

(54) CLEANING FORMULA FOR MOTOR VEHICLE INTAKE AND EXHAUST SYSTEMS

(71) Applicant: BG INTELLECTUALS, INC., Wichita, KS (US)

(72) Inventor: Ken Shriner, Wichita, KS (US)

(73) Assignee: BG INTELLECTUAL, INC., Wichita, KS (US)

( * ) Notice: Subject to any disclaimer, the term of this patent is extended or adjusted under 35 U.S.C. 154(b) by 93 days.

(21) Appl. No.: 14/270,895

(22) Filed: May 6, 2014

(65) Prior Publication Data

US 2014/0331954 A1 Nov. 13, 2014

Related U.S. Application Data

(60) Provisional application No. 61/820,534, filed on May 7, 2013.

(51) Int. Cl.

| | |
|---|---|
| ***C11D 3/20*** | (2006.01) |
| ***C11D 1/72*** | (2006.01) |
| ***C11D 1/40*** | (2006.01) |
| ***C11D 3/28*** | (2006.01) |
| ***C11D 3/30*** | (2006.01) |
| ***C11D 3/43*** | (2006.01) |
| ***C11D 11/00*** | (2006.01) |

(52) U.S. Cl.

CPC ..... *C11D 3/2068* (2013.01); *C11D 1/40* (2013.01); *C11D 1/72* (2013.01); *C11D 3/2003* (2013.01); *C11D 3/2079* (2013.01); *C11D 3/2096* (2013.01); *C11D 3/28* (2013.01); *C11D 3/30* (2013.01); *C11D 3/43* (2013.01); *C11D 11/0041* (2013.01)

(58) Field of Classification Search

CPC ..... C11D 11/0041; C11D 3/43; C11D 1/72; C10L 10/06; F02M 65/007

See application file for complete search history.

(56) References Cited

U.S. PATENT DOCUMENTS

| | | | | |
|---|---|---|---|---|
| 5,091,017 | A * | 2/1992 | Flanner | F02M 65/008 134/22.11 |
| 5,401,326 | A * | 3/1995 | Mihelic | C11D 17/0021 134/38 |
| 5,407,453 | A * | 4/1995 | Pierce-Ruhland | C11D 3/2079 44/302 |
| 6,478,033 | B1 * | 11/2002 | Foster | C11D 3/0073 134/22.1 |
| 6,541,435 | B2 * | 4/2003 | Gatzke | C11D 3/18 510/185 |
| 6,616,776 | B1 * | 9/2003 | Ahmadi | C10L 10/00 134/39 |
| 8,632,638 | B2 * | 1/2014 | Simpson-Green | C11D 7/5022 134/20 |
| 2003/0031964 | A1 * | 2/2003 | Hayward | C11D 3/0084 431/3 |
| 2003/0158060 | A1 * | 8/2003 | Ahmadi | F02B 77/04 510/185 |
| 2003/0158061 | A1 * | 8/2003 | Ahmadi | C10L 10/00 510/185 |
| 2008/0011327 | A1 * | 1/2008 | Shriner | B08B 9/00 134/22.19 |
| 2008/0202561 | A1 * | 8/2008 | DuMont | C10G 75/02 134/20 |

* cited by examiner

*Primary Examiner* — Gregory Webb

(74) *Attorney, Agent, or Firm* — Shook, Hardy & Bacon L.L.P.

(57) ABSTRACT

A cleaning system is provided to reduce, minimize, or eliminate deposits located within gaseous intake, processing, and emissions portions of a vehicle engine. The cleaning system includes use of a cleaning composition for removing such deposits. The cleaning composition can include water; a nitrogen-based dispersant or cleaner; a surfactant; a C6-C18 alcohol; a glycol ether; and an organic acid.

20 Claims, No Drawings

CLEANING FORMULA FOR MOTOR VEHICLE INTAKE AND EXHAUST SYSTEMS

CROSS-REFERENCE TO RELATED APPLICATIONS

This application claims the benefit of priority from provisional application 61/820,534, filed on May 7, 2013 titled "Cleaning Formula for Motor Vehicle Air Intake, EGR System, Turbocharger, and Exhaust System, the entirety of which is incorporated herein by reference.

STATEMENT REGARDING FEDERALLY SPONSORED RESEARCH OR DEVELOPMENT

Not applicable.

FIELD OF THE INVENTION

The invention relates to the cleaning of deposits formed in the air intake system, engine and exhaust of motor vehicles.

BACKGROUND OF THE INVENTION

New vehicles must pass emission standards before being released for sale, which can include testing for nitrogen oxides, hydrocarbons, and carbon monoxide. The emission standards of these three primary substances are continually being lowered and the technology available to achieve the low tailpipe emissions are becoming more complex and costly to implement. Unfortunately, although a newly designed vehicle may pass the emissions criteria, but during service, deposits may build up on the emission control devices, sensors, intake valves, exhaust valves, fuel injectors, and combustion chamber. Such deposits can significantly reduce the ability of an emissions reduction system to reduce tailpipe emissions as designed.

SUMMARY

In an aspect, an aqueous-based cleaning composition for removal of engine deposits is provided. The composition includes about 0.5 vol % to about 10.0 vol % of a nitrogen-based dispersant; about 0.25 vol % to about 4.0 vol % of a surfactant; about 2 vol % to about 12 vol % of an C6 to C18 alcohol; about 2 vol % to about 30 vol % of a glycol ether; about 0.25 vol % to about 4.0 vol % of a C2 to C18 organic acid; and about 30 vol % to about 95 vol % water, such as at least about 40 vol % water, and optionally further includes at least one additional component.

In another aspect, an aqueous-based cleaning composition for removal of engine deposits is provided. The composition includes about 0.5 vol % to about 10.0 vol % of a morpholine, a morpholine derivative, aminopropylmorpholine, benzyl amine, lauryl amine, isononyl amine oleyl amine, or a combination thereof as a nitrogen-based dispersant; about 0.25 vol % to about 4.0 vol % of an alcohol ethoxylate surfactant; about 2 vol % to about 12 vol % of a C6 to C18 alcohol; about 2 vol % to about 30 vol % of a C6 to C12 glycol ether; about 0.25 vol % to about 4.0 vol % of a C2 to C18 organic acid; and about 40 vol % to about 95 vol % water, and optionally further includes at least one additional component.

In still another aspect, a method of cleaning an engine is provided. The method includes introducing a cleaning composition into an air intake system, a turbocharger, a hot exhaust gas recirculation system, or a combination thereof of the engine. The cleaning composition includes about 0.5 vol % to about 10.0 vol % of a nitrogen-based dispersant; about 0.25 vol % to about 4.0 vol % of a surfactant; about 2 vol % to about 12 vol % of an C6 to C18 alcohol; about 2 vol % to about 30 vol % of a ether; about 0.25 vol % to about 4.0 vol % of a C2 to C18 organic acid; and about 40 vol % to about 95 vol % water, and optionally further includes at least one additional component.

DETAILED DESCRIPTION

In various aspects, a cleaning system has been developed which can effectively reduce, minimize, or eliminate deposits located within gaseous intake, processing, and emissions portions of a vehicle engine. The cleaning system can improve vehicle emissions and/or drivability, such as by helping to restore vehicle emissions and/or drivability back to near new performance. Additionally or alternately, the cleaning system can improve one or more of the torque, horsepower or idle control of a vehicle engine.

In various aspects, the advantages noted above can be achieved in part by removing deposits in diesel powered engines that contribute to higher exhaust emissions, reduced performance, and/or lower fuel economy relative to the operation of an engine in a new vehicle. It has been determined that the removal of such deposits can be enabled and/or enhanced by use of a chemical solution. The chemical solution can be comprised of water, organic based solvents, and (optionally organic) surfactants. In some aspects, the chemical solution provides a high level of dispersant activity toward 'soot' and/or degraded engine oil found in one or more of the air intake system, exhaust gas recycle (EGR) system, turbocharger and exhaust systems of motor vehicles. Optionally but preferably, the chemical solution provides a high level of dispersant activity toward soot and/or degraded engine oil found in a plurality of the air intake system, EGR system, turbocharger and exhaust systems of motor vehicles, such as in all of the systems.

Additionally or alternately, another feature of the cleaning solution is the versatility of the cleaning solution for use in multiple cleaning applications in motor vehicles, including the air intake system, EGR system (including the EGR cooler), turbocharger, exhaust temperature sensors, exhaust oxygen sensors, oxidation catalysts, and particulate filters. The chemistry of the cleaning solution is believed to be suitable for cleaning any of these components without damage and/or with reduced or minimized damage. Additionally, the chemistry of the cleaning solution provides unexpectedly improved cleaning relative to conventional chemistries.

In various aspects, the cleaning composition can be an aqueous-based composition, in order to provide, for example, suitable solvation power for inorganic portions of deposits located within an engine. An aqueous-based composition can also be beneficial for reducing the overall vapor pressure (i.e. providing a low volatility) of the cleaning composition, as well as possibly mitigating the potential flammability of the composition. Preferably, the cleaning composition can also include a dispersant that is suitable for removing deposits from engine surfaces. Optionally but preferably, when the cleaning composition is introduced into an engine while running, the dispersant and/or other components in the cleaning composition can also break down into compounds that further assist with removal of deposits. Preferably, the cleaning composition can also include a surfactant to assist with allowing the cleaning composition to form an oil-in-water emulsion. Preferably, the combination of the components in the cleaning composition can be suitable for use in general work environments. This can include having a cleaning composition with a relatively low volatility and/or low amount of volatile organic compounds; a cleaning composition with a high flash point; a cleaning composition with a low toxicity; a cleaning composition that is reasonably biodegradable; and/or a cleaning composition with a pH that is low enough to reduce or minimize damage to metal alloys. Optionally, the cleaning composition can also include one or more components that provide auxiliary benefits, such as dyes to allow for easier visual identification of the cleaning composition.

In order to provide one or more or the above features, the cleaning composition can include a variety of components. For example, the cleaning composition can include water; a nitrogen-based dispersant or cleaner; a surfactant; a C6-C18 alcohol; at glycol ether; and an organic acid.

In various aspects, the cleaning composition contains a nitrogen-based dispersant/cleaner such as morpholine or a derivative of morpholine. For example, aminopropylmorpholine is a preferred nitrogen-based dispersant. In other aspects, amine-based compounds that are not excessively volatile can be used in place of or in addition to morpholine or a morpholine derivative. Suitable amine-based compounds include C6 to C30 amines as aromatic amines, straight chain amines, branched chain amines, and unsaturated amines. Examples of suitable amine-based compounds include benzyl amine, lauryl amine, isononyl amine, and oleyl amine. Low molecular weight ether amines and polyether amines also potentially be used, such as amines from the Huntsman Jeffamine® series of amines and polyether amines.

The nitrogen-based dispersant can be present in an amount of from about 0.5 vol % to about 10 vol %. For example, the cleaning composition can contain at least about 0.5 vol %, or at least about 1.0 vol %, or at least about 1.5 vol %, or at least about 2.0 vol %, or at least about 2.5 vol %, or at least about 3.0 vol % of the nitrogen-based dispersant. Additionally or alternately, the cleaning composition can contain about 10.0 vol % or less, or about 8.0 vol % or less, or about 6.0 vol % or less of the nitrogen-based dispersant.

As an example, aminopropylmorpholine has a relative high pH as well as a high level of ability to solvate the oxidized and/or thermally decomposed motor oil, gasoline, diesel and exhaust gas recirculation residue of which typical engine deposits are composed. Aminopropylmorpholine can also function as a dispersant to break up and suspend carbonaceous, soot-like deposits. Such carbonaceous deposits, which can account for a significant portion of the deposits found in diesel engines, can be resistant to dissolving in conventional cleaning fluids. Still another potential benefit of aminopropylmorpholine and other similar amines is that the breakdown products of the amine in the combustion chamber tend to have a strong cleaning effect downstream in the exhaust system.

In various aspects, the cleaning composition also contains a surfactant, such as a non-ionic surfactant. The surfactant can be a surfactant with suitable hydrophilic-lipophilic balance values to create a stable "oil in water" emulsion. (Hydrophilic-lipophilic balance value can sometimes be abbreviated either as HLB value or HBL value.) Suitable hydrophilic-lipophilic balance numbers for a surfactant suitable for creating "oil in water" emulsion can range from about 12 to about 16 according to Griffin's method bar determining HLB values. The surfactant can also aid in the cleaning process, and preferably the surfactant will not leave a gummy, sticky residue behind after the service with the described chemistry. Without being bound by any particular theory, it is believed that ionic surfactants have an increased likelihood of producing a gummy and/or sticky residue after a cleaning service when used as part of a cleaning composition. Examples of suitable surfactants can include alcohol ethoxylates such as Dow Ecosurf™ EH-9. Other (preferably non-ionic) surfactants or combinations of surfactants can also be used in the cleaning composition as long as a stable "oil in water" emulsion is created and cleaning with the chemistry is achieved without a sticky residue remaining.

The surfactant can be present in an amount of from about 0.25 vol % to about 4.0 vol %. For example, the cleaning composition can contain at least about 0.25 vol %, or at least about 0.5 vol %, or at least about 0.75 vol %, or at least about 1.0 vol %, or at least about 1.5 vol % of the surfactant. Additionally or alternately, the cleaning composition can contain about 4.0 vol % or less, or about 3.0 vol % or less, or about 2.5 vol % or less, or about 2.0 vol % or less of the surfactant.

In various aspects, the cleaning composition also contains an alcohol, such as an alcohol that can provide a synergistic cleaning effect as part of the chemical composition. Suitable alcohols can include C6 to C18 alcohols. Alcohols having between about 6 to about 18 carbons can tend to have suitable properties with regard to sufficiently high flash points, sufficiently low vapor pressures, sufficiently low toxicities, and suitable biodegradability. An example of a suitable alcohol is tetrahydrofurfuryl, as tetrahydrofurfuryl provides good solvation for deposits while, also having desirable properties with regard to low toxicity, biodegradability, high flash point and low vapor pressure compared to other commonly available alcohols. Additionally, the thermal breakdown products of tetrahydrofurfuryl alcohol in the combustion chamber of an engine tend to have a cleaning effect down steam in the exhaust system.

The alcohol can be present in an amount of from about 2 vol % to about 12 vol %. For example, the cleaning composition can contain at least about 2 or at least about 3 vol %, or at least about 4 vol %, or at least about 5 vol %, or at least about 6 vol % of the alcohol. Additionally or alternately, the cleaning composition can contain about 12 vol % or less, or about 10 vol % or less, or about 9 vol % or less, or about 8 vol % or less of the alcohol.

In various aspects, the cleaning composition also contains a glycol ether. Suitable glycol ethers can include dipropylene glycol methyl ether, diethylene glycol butyl ether, and other glycol ethers with vapor pressures suitable for allowing the cleaning composition to meet overall volatile organic carbon (VOC) requirements, such as C6-C12 glycol ethers.

The glycol ether can be present in an amount of from about 2 vol % to about 30 vol %. For example, the cleaning composition can contain at least about 2 vol %, or at least about 5 vol %, or at least about 10 vol %, or at least about 16 vol %, or at least about 20 vol % of the glycol ether. Additionally or alternately, the cleaning composition can contain about 30 vol % or less, or about 25 vol % or less, or about 20 vol % or less, or about 16 vol % or less of the glycol ether.

In various aspects, the cleaning composition also contains an organic acid. The organic acid can be used in the cleaning composition as a neutralizing agent to lower the pH. A pH lower than 12.0 can be desired in some applications to prevent corrosion to aluminum allows and other metal alloys that are prone to corrosion under high pH (caustic conditions). Suitable organic acids can include C2 to C18 organic acids in sufficient amounts to produce a desired pH, such as a pH lower than about 12.0, or lower than about 11.5, or lower than about 11.0, or lower than about 10.0, in order to provide protection to aluminum alloys and/or other metal alloys present in an engine. An example of a suitable organic acid is 2-ethylhexanoic acid. Branched organic acids such as 2-ethylhexanoic acid are also believed to be suitable for enhancing the cleaning effect of the cleaning composition.

The organic acid can be present in an amount of from about 0.25 vol % to about 4.0 vol %. For example, the cleaning composition can contain at least about 0.25 vol %, or at least about 0.5 vol %, or at least about 0.75 vol %, or at least about 1.0 vol %, or at least about 1.5 vol % of the organic acid. Additionally or alternately, the cleaning composition can contain about 4.0 vol % or less, or about 3.0 vol % or less, or about 2.5 vol % or less, or about 2.0 vol % or less of the organic acid.

In various aspects, the balance of the volume of the cleaning composition, or at least a substantial portion of the balance of the volume of the cleaning composition, corresponds to water. An aqueous-based cleaning composition, such as a composition containing at least about 30 vol % water, can aid in carbon dispersion and in the solubilizing of some types of deposits found in vehicle air intake systems, engines and exhaust systems. Using an aqueous-based cleaning composition can also assist with removal of diesel particulate filter (DPF) deposits, which can contain primarily oxidized metal salts and partially decomposed portions of motor oil additives.

Water can be present in an amount from about 30 vol % to about 95 vol % in the cleaning composition. For example, the cleaning composition can include about 30 vol % water, or about 40 vol %, or about 50 vol %, or about 60 vol % or about 70 vol %. Additionally or alternately, the cleaning composition can include about 95 vol % water or less, or about 85 vol % or less, or about 75 vol % or less, or about 65 vol % or less, or about 55 vol % or less.

In some aspects, additional components may also be present in the cleaning composition. For example, many fluids used within an engine environment have is distinctive rotor and/or appearance in order to assist with identifying such fluids outside of an engine. In order to facilitate identification, the cleaning composition can include one or more dyes, such as a blue-colored dye, in order to assist with identifying die nature of the cleaning composition when it exits from the engine. Suitable amounts of dye to include in the cleaning composition can correspond to less than 1 vol % of the composition, such as less than 0.1 vol % of the composition, for example about 0.02 vol % of less. Other components can also be incorporated into the cleaning composition for auxiliary purposes so long as the components do not substantially interfere with the ability of the cleaning composition to remove the desired deposits while meeting other desired characteristics of the composition.

The cleaning composition can be used to remove deposits and/or otherwise clean an engine under a variety of conditions. The cleaning composition is suitable for removing deposits at ambient temperatures, such as a temperature of about 50° F. to about 85° F., for example a temperature of at least about 70° F. More generally, the cleaning composition can be used at a variety of elevated temperatures, such as typical operating temperatures for an engine in a motor vehicle. For example, the cleaning composition can be introduced into an engine while running, such as by introducing the cleaning composition into an air intake system, a turbocharger, a hot exhaust gas recirculation system, or into another convenient location. Optionally, the cleaning composition can be pre-heated prior to introducing the composition into the engine. Suitable temperatures for pre-heating the cleaning composition can range from about 100° F. to about 212° F.

After use of the cleaning composition, an engine can exhibit as variety of improved properties, such as an increase in horsepower and/or torque; a decrease in the amount of time required for regeneration of a diesel particulate filler; a drop in vehicle exhaust emissions; reductions in vehicle vibration during idle and/or improved acceleration; and improvements in fuel economy.

Embodiments of the invention have been described to be illustrative rather than restrictive. It will be understood that certain features and subcombinations are of utility and may be employed without reference to other features and subcombinations. This is contemplated by and is within the scope of the claims.

ADDITIONAL EMBODIMENTS

Embodiment 1

An aqueous-based cleaning composition for removal of engine deposits comprising: about 0.5 vol % to about 10.0 vol % or a nitrogen-based dispersant; about 0.25 vol % to about 4.0 vol % of a surfactant; about 2 vol % to about 12 vol % of an C6 to C18 alcohol; about 2 vol % to about 30 of a glycol ether; about 0.25 vol % to about 40 vol % of a C2 to C18 organic acid; and about 30 vol % to about 95 vol % water, such as at least about 40 vol % water; and optionally further comprising at least one additional component.

Embodiment 2

The aqueous-based cleaning composition of Embodiment 1, wherein the surfactant is an alcohol ethoxylate.

Embodiment 3

The aqueous-based cleaning composition of any of the above embodiments, wherein the nitrogen-based dispersant is morpholine, a morpholine derivative, aminopropylmorpholine, benzyl amine, laurel amine, isononyl amine, oleyl amine, or a combination thereof.

Embodiment 4

An aqueous-based cleaning composition for removal of engine deposits, comprising: about 0.5 vol % to about 10.0 vol % of a morpholine, a morpholine derivative, aminopropylmorpholine, benzyl amine, lauryl amine, isononyl amine, oleyl amine, or a combination thereof as a nitrogen-based dispersant; about 0.25 vol % to about 4.0 vol % of an alcohol ethoxylate surfactant; about 2 vol % to about 12 vol % of a C6 to C18 alcohol; about 2 vol % to about 30 vol % of a C6 to C12 glycol ether; about 0.25 vol % to about 4.0 vol % of a C2 to C18 organic acid, and about 40 vol % to about 95 vol % water, and optionally further comprising at least one additional component.

Embodiment 5

The aqueous-based cleaning composition of any of the above embodiments, wherein the C6 to C18 alcohol is tetrahydrofuryl alcohol.

Embodiment 6

The aqueous-based cleaning composition of any of the above embodiments, wherein the glycol ether (or C6 to C12 glycol ether) is dipropylene glycol methyl ether, diethylene glycol butyl ether, or a combination thereof.

Embodiment 7

The aqueous-based cleaning composition of any of the above embodiments, wherein the C2 to C18 organic acid is ethylhexanoic acid.

Embodiment 8

The aqueous-based cleaning composition of any of the above embodiments, wherein the composition comprises at least one of about 5 vol % of the C6 to C18 alcohol, about 6 vol % or less of the nitrogen-based dispersant, about 2 vol % or less of the C2 to C18 organic acid, or about 2 vol % or less of the surfactant, or at least about 10 vol % of the glycol ether, or at least two of the above, or at least three of the above, or at least four of the above, or all of the above.

Embodiment 9

The aqueous-based cleaning composition of any of the above embodiments, wherein the composition comprises about 0.5 vol % to about 6.0 vol % of a morpholine, a morpholine derivative, aminopropylmorpholine, benzyl amine, lauryl amine, isononyl amine, oleyl amine, or a combination thereof; about 0.25 vol % to about 2.0 vol % of an alcohol ethoxylate surfactant; about 5 vol % to about 12 vol % of a C6 to C18 alcohol; about 10 vol % to about 30 vol % of a C6 to C12 glycol ether; about 0.25 vol % to about 4.0 vol % of a C1 to C12 organic acid; and about 45 vol % to about 84 vol % water, and optionally at least one additional component.

Embodiment 10

A method of cleaning an engine, comprising introducing a cleaning composition according to any or the above embodiments into an air intake system, a turbocharger, a hot exhaust gas recirculation system, or a combination thereof of the engine.

Embodiment 11

The method of Embodiment 10, wherein the cleaning composition is introduced into the engine while the engine is running.

Embodiment 12

The method of Embodiment 11, wherein the cleaning composition is heated to a temperature of about 100° F. to about 212° F. prior to introducing the cleaning composition into the engine.

Embodiment 13

The method of Embodiment 10 or 11, wherein the cleaning composition is introduced into the engine at an ambient temperature.

What is claimed is:

1. An aqueous-based cleaning composition for removal of engine deposits, comprising:
- about 0.5 vol % to about 10.0 vol % of a nitrogen-based dispersant;
- about 0.25 vol % to about 4.0 vol % of a surfactant;
- about 2 vol % to about 12 vol % of an C6 to C18 alcohol;
- about 2 vol % to about 30 vol % of a glycol ether;
- about 0.25 vol % to about 4.0 vol % of a C2 to C18 organic acid; and
- about 30 vol % to about 95 vol % water.

2. The aqueous-based cleaning composition of claim 1, wherein the C6 to C18 alcohol is tetrahydrofuryl alcohol.

3. The aqueous-based cleaning composition of claim 1, wherein the glycol ether is dipropylene glycol methyl ether, diethylene glycol butyl ether, or a combination thereof.

4. The aqueous-based cleaning composition of claim 1, wherein the C2 to C18 organic acid is ethylhexanoic acid.

5. The aqueous-based cleaning composition of claim 1, wherein the surfactant is an alcohol ethoxylate.

6. The aqueous-based cleaning composition of claim 1, wherein the nitrogen-based dispersant is morpholine, a morpholine derivative, aminopropylmorpholine, benzyl amine, lauryl amine, isononyl amine, oleyl amine, or a combination thereof.

7. The aqueous-based cleaning composition of claim 1, wherein the composition comprises at least about 5 vol % of the C6 to C18 alcohol, about 6 vol % or less of the nitrogen-based dispersant, about or less of the C2 to C18 organic acid, or about 2 vol % or less of the surfactant.

8. The aqueous-based cleaning composition of claim 1, wherein the composition comprises at least about 5 vol % of the C6 to C18 alcohol, about 6 vol % or less of the nitrogen-based dispersant, about 2 vol % or less of the C2 to C18 organic acid, and about 2 vol % or less of the surfactant.

9. The aqueous-based cleaning composition of claim 1, wherein the composition further comprises at least one additional component.

10. The aqueous-based cleaning composition of claim 1, wherein the composition comprises at least about 10 vol % of the glycol ether.

11. An aqueous-based cleaning composition for removal of engine deposits, comprising:
- about 0.5 vol % to about 10.0 vol % of a morpholine, a morpholine derivative, aminopropylmorpholine, benzyl amine, lauryl amine, isononyl amine, oleyl amine, or a combination thereof;
- about 0.25 vol % to about 4.0 vol % of an alcohol ethoxylate surfactant;
- about 2 vol % to about 12 vol % of a C6 to C18 alcohol;
- about 2 vol % to about 30 vol % of a C6 to C12 glycol ether;
- about 0.25 vol % to about 4.0 vol % of a C2 to C18 organic acid; and
- about 40 vol % to about 95 vol % water.

12. The aqueous-based cleaning composition of claim 11, wherein the C6 to C18 alcohol is tetrahydrofuryl alcohol.

13. The aqueous-based cleaning composition of claim 11, wherein the C6 to C12 glycol ether is dipropylene glycol methyl ether, diethylene glycol butyl ether, or a combination thereof.

14. The aqueous-based cleaning composition of claim 11, wherein the C2 to C18 organic acid is ethylhexanoic acid.

15. A method of cleaning an engine, comprising:
- introducing a cleaning composition into an air intake system, a turbocharger, a hot exhaust gas recirculation system, or a combination thereof of the engine, the cleaning composition comprising:
  - about 0.41 vol % to about 10.0 vol % of a nitrogen-based dispersant;
  - about 0.25 vol % to about 4.0 vol % of a surfactant;
  - about 2 vol % to about 12 vol % of an C6 to C18 alcohol;
  - about 2 vol % to about 30 vol % of a glycol ether;
  - about 0.25 vol % to about 4.0 vol % of a C2 to C18 organic acid; and
  - about 40 vol % to about 95 vol % water.

16. The method of claim 15, wherein the cleaning composition is introduced into the engine while the engine is running.

17. The method of claim 16, wherein the cleaning composition is heated to a temperature of about 100° F. to about 212° F. prior to introducing the cleaning composition into the engine.

18. The method of claim 15, wherein the cleaning composition is introduced into the engine at an ambient temperature.

19. The method of claim 15, wherein the cleaning composition further comprises an additional component.

20. The method of claim 15, wherein the cleaning composition comprises about 0.5 vol % to about 6.0 vol % of a morpholine, a morpholine derivative, aminopropylmorpholine, benzyl amine, lauryl amine, isononyl amine, oleyl amine, or a combination thereof;

about 0.25 vol % to about 2.0 vol % of an alcohol ethoxylate surfactant;

about 5 vol % to about 12 vol % of a C6 to C18 alcohol;

about 10 vol % to about 30 vol % of a C6 to C12 glycol ether;

about 0.25 vol % to about 4.0 vol % of a C2 to C18 organic acid; and about 45 vol % to about 84 vol % water.

* * * * *